US012747070B2

(12) United States Patent
Petlak et al.

(10) Patent No.: US 12,747,070 B2
(45) Date of Patent: Sep. 29, 2026

(54) STRAWLESS DRINKING LID FOR A CONTAINER

(71) Applicant: PACTIV LLC, Lake Forest, IL (US)

(72) Inventors: Frank A Petlak, Antioch, IL (US); Jeff Hautzinger, Chicago, IL (US); Mark R. Gartz, Mt. Prospect, IL (US); Sam T. Baricovich, Lisle, IL (US)

(73) Assignee: PACTIV LLC, Lake Forest, IL (US)

( * ) Notice: Subject to any disclaimer, the term of this patent is extended or adjusted under 35 U.S.C. 154(b) by 0 days.

(21) Appl. No.: 18/606,575

(22) Filed: Mar. 15, 2024

(65) Prior Publication Data

US 2024/0327076 A1 Oct. 3, 2024

Related U.S. Application Data

(60) Provisional application No. 63/493,584, filed on Mar. 31, 2023.

(51) Int. Cl.
*B65D 43/02* (2006.01)

(52) U.S. Cl.
CPC ..... *B65D 43/0222* (2013.01); *B65D 2543/00046* (2013.01); *B65D 2543/00092* (2013.01); *B65D 2543/00296* (2013.01); *B65D 2543/00527* (2013.01); *B65D 2543/00537* (2013.01);

(Continued)

(58) Field of Classification Search
CPC .. B65D 47/065; B65D 47/066; B65D 47/063; B65D 47/061; B65D 47/2018; B65D 25/44
See application file for complete search history.

(56) References Cited

U.S. PATENT DOCUMENTS 3,227,304 A 1/1966 Ashury
3,362,569 A 1/1968 Geiger
3,927,794 A 12/1975 Erdman
(Continued)

FOREIGN PATENT DOCUMENTS

CA 1 007 183 A 3/1977
CA 3 108 021 A1 2/2020
(Continued)

OTHER PUBLICATIONS

U.S. App. No. 18/606,2018, filed Mar. 15, 2024.

*Primary Examiner* — Jeffrey R Allen
(74) *Attorney, Agent, or Firm* — Baker Botts L.L.P.

(57) ABSTRACT

Strawless drinking lid for a container, having a mounting portion defining an outer perimeter, and a perimeter wall disposed inwardly from the mounting portion. The perimeter wall extends upwardly relative the mounting portion and has an outer surface facing the mounting portion and an inner surface opposite the outer surface. The strawless drinking lid further has a center portion extending inwardly from the inner surface of the perimeter wall and a raised drinking portion extending upwardly from the center portion. The drinking portion has a front section and a back section with an upper surface therebetween. The front section of the raised drinking portion has a front edge proximate the inner surface of the perimeter wall, and the back section of the raised drinking portion has a back surface extending upwardly from the center portion. The raised drinking portion has a closed configuration and an open configuration.

20 Claims, 10 Drawing Sheets

(52) U.S. Cl.
CPC ..... *B65D 2543/00768* (2013.01); *B65D 2543/00796* (2013.01)

(56) References Cited

U.S. PATENT DOCUMENTS

| | | | | |
|---|---|---|---|---|
| 3,929,251 | A | 12/1975 | Urmston | |
| 4,113,135 | A | 9/1978 | Yamazaki | |
| 4,184,604 | A | 1/1980 | Amberg et al. | |
| 4,925,051 | A * | 5/1990 | Herbst | B65D 17/401 D9/438 |
| 6,419,105 | B1 | 7/2002 | Bruce et al. | |
| 7,691,302 | B2 | 4/2010 | Hollis et al. | |
| 7,753,224 | B2 | 7/2010 | Cai | |
| 7,789,260 | B2 | 9/2010 | Hollis et al. | |
| 7,819,271 | B2 | 10/2010 | Hollis et al. | |
| 8,113,379 | B2 | 2/2012 | Cai et al. | |
| 8,317,050 | B2 | 11/2012 | Hollis et al. | |
| D887,203 | S | 6/2020 | Pan | |
| D890,568 | S | 7/2020 | Davis | |
| 10,759,574 | B1 | 9/2020 | Li | |
| D900,605 | S | 11/2020 | Li | |
| D921,423 | S | 6/2021 | Horgan et al. | |
| 2007/0131691 | A1 | 6/2007 | Evans | |
| 2019/0276199 | A1* | 9/2019 | Wood | B65D 47/063 |
| 2020/0062462 | A1 | 2/2020 | Baird | |

FOREIGN PATENT DOCUMENTS

| | | | |
|---|---|---|---|
| CA | 3 137 650 | A1 | 12/2020 |
| WO | WO 2018/096503 | A1 | 5/2018 |
| WO | WO 2022/086876 | A1 | 4/2022 |

* cited by examiner

STRAWLESS DRINKING LID FOR A CONTAINER

CROSS REFERENCE TO RELATED APPLICATIONS

This application claims the benefit of U.S. Provisional Patent Application No. 63/493,584 filed Mar. 31, 2023, which is hereby incorporated by reference in its entirety.

BACKGROUND

Field of the Disclosed Subject Matter

The disclosed subject matter relates generally to the field of containers, specifically, the construction of a lid for a container such as a cup, bowl or the like. More specifically, the disclosed subject matter relates to a strawless drinking lid for a container and a method of forming the same.

Description of the Related Art

A variety of lids for containers, such as cup, bowl or the like for food and beverages, are well known in the art. Such container lids are relatively inexpensive and disposable; and therefore are extremely popular. In particular, container lids that are strawless and reclosable are often used at parties, picnics, gatherings, and other everyday occasions where portability and minimal clean-up are desired.

A disadvantage of many existing non-reclosable and reclosable container lid designs is that conventional non-reclosable and reclosable container lids often contain pre-stamped through-holes for sipping or straws. Such through-holes require slugs to be removed and collected during manufacture, which add an extra step to the manufacture process. Moreover, since such non-reclosable and reclosable container lids are manufactured with the sip hole open, this is a disadvantage for delivery services and other occasions where ease of portability and use are necessary, and can cause other concerns. Other existing reclosable container lid designs, such as hinged flap designs, tethered plug designs, attached plug designs, and accessory plug designs, can be difficult to operate and require more dexterity. Such existing reclosable container lid designs with flaps or plugs have the additional disadvantages of a flap or plug that can be inconvenient while drinking or snag when closing the container. Moreover, tethered/attached/accessory plug designs can be more difficult to manufacture, have additional assembly or manufacturing costs, and uses additional plastic (i.e., not a green solution).

The disclosed subject matter is intended to provide a strawless drinking lid for a container which provides a solution to the recognized problems.

SUMMARY OF THE DISCLOSED SUBJECT MATTER

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

The disclosed subject matter includes a strawless drinking lid for a container, having a mounting portion defining an outer perimeter, and a perimeter wall disposed inwardly from the mounting portion. The perimeter wall extends upwardly relative the mounting portion and has an outer surface facing the mounting portion and an inner surface opposite the outer surface. The strawless drinking lid further has a center portion extending inwardly from the inner surface of the perimeter wall and a raised drinking portion extending upwardly from the center portion. The drinking portion has a front section and a back section with an upper surface therebetween. The front section of the raised drinking portion has a front edge proximate the inner surface of the perimeter wall, and the back section of the raised drinking portion has a back surface extending upwardly from the center portion. The raised drinking portion has a closed configuration with the upper surface undeformed and the front edge adjacent the inner surface of the perimeter wall. The raised drinking portion has an open configuration with the upper surface deformed downwardly to define an opening between the front edge and the inner surface of the perimeter wall.

As embodied herein, the raised drinking portion can be deformed downwardly past a point of maximum opening stress. The raised drinking portion can be configured to be moved from the closed configuration toward the open configuration by an external pushing force applied on the back surface of the back section. The back section of the raised drinking portion can include a ridge. The raised drinking portion can be configured to be moved from the open configuration toward the closed configuration by an external pulling force applied on the ridge. The ridge can be raised relative to the upper surface of the raised drinking portion. The raised drinking portion can include at least one groove disposed in the upper surface. The back surface of the back section of the raised portion can be sloped relative to the center portion. The back section of the raised portion can have a slope of between approximately 35 to 60 degrees relative to the center portion. The upper surface of the raised drinking portion can have a convex barrel shape in the closed configuration. The front edge can have a curve defined along an interface between the upper surface of the raised drinking portion and the inner surface of the perimeter wall.

As embodied herein, the strawless drinking lid can further include a raised projection between the center portion and the raised drinking portion. The raised projection can have a maximum height relative to the center portion less than a minimum height of the inner surface of the perimeter wall relative to the center portion.

As embodied herein, the perimeter wall can have a front wall segment and a back wall segment. The front wall segment can have a maximum height greater than a maximum height of the back wall segment. The front wall segment can taper down from the maximum height of the front wall segment to the maximum height of the back wall segment. The maximum height of the front wall segment can be approximately 0.38 to 0.75 inch relative to a top of the mounting portion.

As embodied herein, the mounting portion can be configured to engage an upper rim of a container. The mounting portion can include an inner shelf extending radially inward to the outer surface of the perimeter wall. The outer perimeter defined by the mounting portion can be circular in plan view. The strawless drinking lid can consist essentially of a single-piece thermoformed polymer article.

The disclosed subject matter also includes a method of making a strawless drinking lid for a container, including providing a sheet of thermoformable polymeric material and thermoforming the sheet to create a hollow body including a mounting portion defining an outer perimeter. The hollow body further includes a perimeter wall disposed inwardly from the mounting portion, the perimeter wall extending upwardly relative the mounting portion and has an outer surface facing the mounting portion and an inner surface opposite the outer surface. The hollow body further includes a center portion extending inwardly from the inner surface of the perimeter wall. The hollow body further includes a raised drinking portion extending upwardly from the center portion, the drinking portion having a front section and a back section with an upper surface therebetween, the front section of the raised drinking portion having a front edge proximate the inner surface of the perimeter wall, the back section of the raised drinking portion having a back surface extending upwardly from the center portion. The hollow body further includes a raised drinking portion having a closed configuration with the upper surface undeformed and the front edge adjacent the inner surface of the perimeter wall, and the raised drinking portion having an open configuration with the upper surface deformed downwardly to define an opening between the front edge and the inner surface of the perimeter wall.

As embodied here, the raised drinking portion can be configured to be moved from the closed configuration toward the open configuration by an external pushing force applied on the back surface of the back section.

It is to be understood that both the foregoing general description and the following detailed description are exemplary and are intended to provide further explanation of the disclosed subject matter.

The accompanying drawings, which are incorporated in and constitute part of this specification, are included to illustrate and provide a further understanding of the method and system of the disclosed subject matter. Together with the description, the drawings serve to explain the principles of the disclosed subject matter.

DETAILED DESCRIPTION OF THE DISCLOSED SUBJECT MATTER

Reference will now be made in detail to the embodiments of the disclosed subject matter, an example of which is illustrated in the accompanying drawings.

Disclosed herein is a strawless drinking lid for a container having a mounting portion defining an outer perimeter, and a perimeter wall disposed inwardly from the mounting portion. The perimeter wall extends upwardly relative the mounting portion and has an outer surface facing the mounting portion and an inner surface opposite the outer surface. The strawless drinking lid further has a center portion extending inwardly from the inner surface of the perimeter wall and a raised drinking portion extending upwardly from the center portion. The drinking portion has a front section and a back section with an upper surface therebetween. The front section of the raised drinking portion has a front edge proximate the inner surface of the perimeter wall, and the back section of the raised drinking portion has a back surface extending upwardly from the center portion. The raised drinking portion has a closed configuration with the upper surface undeformed and the front edge adjacent the inner surface of the perimeter wall. The raised drinking portion has an open configuration with the upper surface deformed downwardly to define an opening between the front edge and the inner surface of the perimeter wall.

Figure 1:
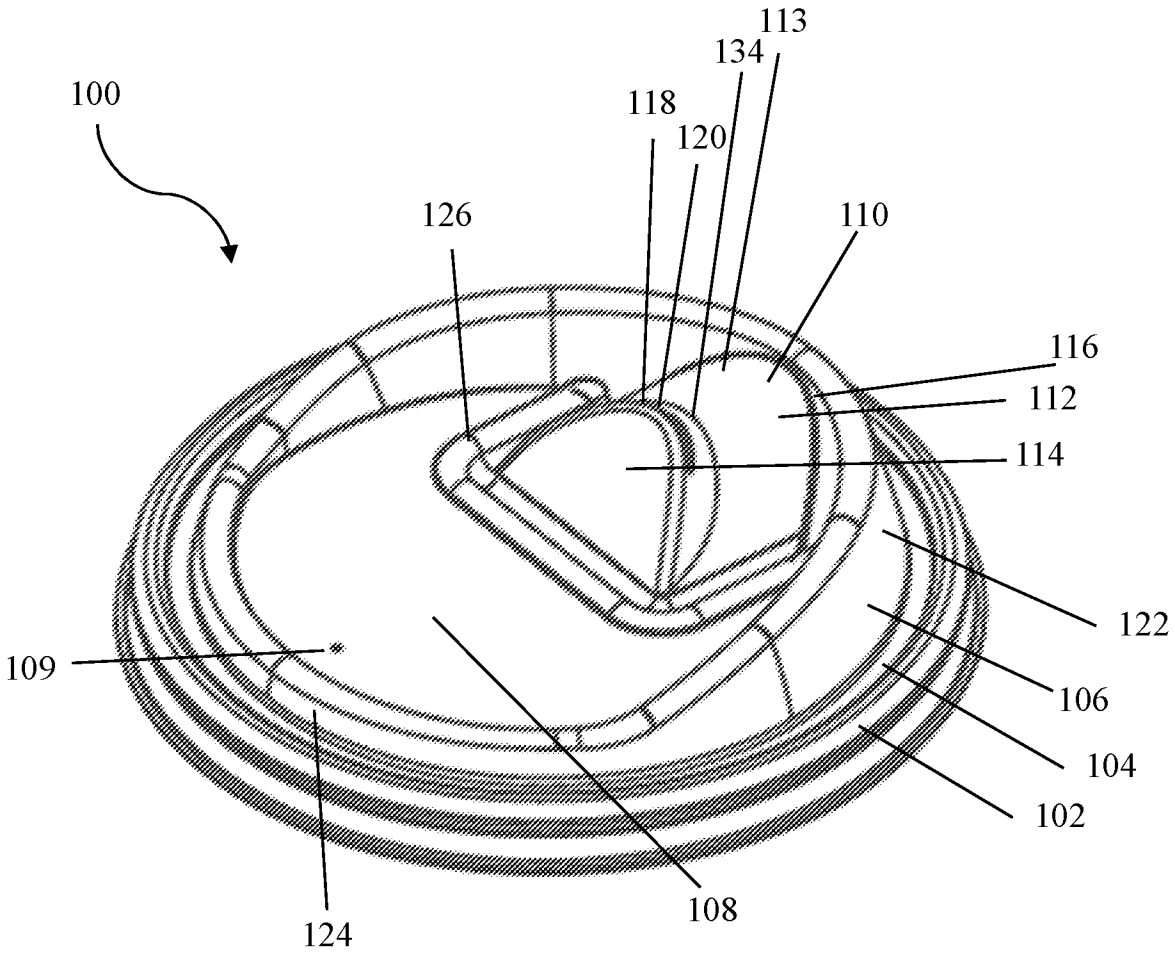
FIG. 1 is a perspective view of a lid for a container according to an aspect of the disclosed subject matter.

For purpose of explanation and illustration, and not limitation, an exemplary container lid in accordance with the disclosed subject matter is shown in FIG. 1 as is designated by reference character 100. While the disclosed subject matter is particularly designed for use with cups, other types of containers may also be capable of utilizing and benefiting from the disclosed subject matter. The disclosed subject matter can be used for a wide variety of containers, including but not limited to beverage cups, food containers, plates, and lids. Additionally, as used herein, the terms "front," "rear," "back," "side," "top," "bottom," "inner," and "outer" are used for the purpose of illustration only, and not limitation. That is, it is recognized that the terms "front," "rear," "back," "side," "top," "bottom," "inner," and "outer" are merely used herein as a point of reference.

As embodied herein and depicted in FIGS. 1-4, the strawless drinking lid 100 for a container has a mounting portion 102 defining an outer perimeter, and a perimeter wall 106 disposed inwardly from the mounting portion 102. The perimeter wall 106 extends upwardly relative the mounting portion 102 and has an outer surface facing the mounting portion 102 and an inner surface opposite the outer surface. The strawless drinking lid 100 further has a center portion 108 extending inwardly from the inner surface of the perimeter wall 106 and a raised drinking portion 110 extending upwardly from the center portion 108. The drinking portion 110 has a front section 112 and a back section 114 with an upper surface 113 therebetween. The front section 112 of the raised drinking portion 110 has a front edge 116 proximate the inner surface of the perimeter wall 106, and the back section 114 of the raised drinking portion 110 has a back surface extending upwardly from the center portion 108. The raised drinking portion 110 has a closed configuration with the upper surface 113 undeformed and the front edge 116 adjacent the inner surface of the perimeter wall 106. The raised drinking portion 110 has an open configuration with the upper surface 113 deformed downwardly to define an opening between the front edge 116 and the inner surface of the perimeter wall 106. During the process of deformation, specifically in opening or closing the strawless drinking lid, an external force is applied which deforms the material of the raised drinking portion 110 past a point of maximum stress, resulting in the raised drinking portion 110 maintained in the open or closed configuration.

As shown generally in FIGS. 1-4, the raised drinking portion 110 can be configured to be moved from the closed configuration toward the open configuration by an external pushing force applied on the back surface of the back section 114. The back section 114 of the raised drinking portion 110 can include a ridge 118. The raised drinking portion 110 can include at least one groove 120 disposed in the upper surface 113. The raised drinking portion 110 can be configured to be moved from the open configuration toward the closed configuration by an external pulling force applied on the ridge 118 or the at least one groove 120, where the external pulling force deforms raised drinking portion 110 past a point of maximum closing stress to close the drinking area of the lid, such that raised drinking portion 110 is maintained in the closed configuration. The ridge 118 can be raised relative to the upper surface 113 of the raised drinking portion 110. As the upper surface 113 deforms, an accordion detail (e.g., as shown by at least one groove 120) allows for the upper surface 113 to deform. For purpose of illustration and not limitation, thicker or more rigid material can include the accordion detail to reduce material stress while operating (e.g. causing cracks) and/or improve the user experience (e.g. force to open/close). The accordion detail's height and depth can be adjusted according to additional deformation desired. The upper surface 113 can include a hinge line 134 to define a front area of raised drinking portion 110 and a back area of raised drinking portion 110. The hinge line 134 can assist in deformation of the raised drinking portion 110 as the raised drinking portion 110 transitions between the open configuration and the closed configuration, where an external closing force deforms raised drinking portion 110 past a point of maximum closing stress to close the drinking area of the lid, such that the raised drinking portion 110 is maintained in the closed configuration. The hinge line 134 can also assist with distributing material stress of the raised drinking portion 110 such that the raised drinking portion 110 can resist cracking caused by repeated deformation.

As shown generally in FIGS. 1-4, the back surface of the back section 114 of the raised drinking portion 110 can be sloped relative to the center portion 108. The back section 114 of the raised drinking portion 110 can have a slope of between approximately 35 to 60 degrees relative to the center portion 108. The back section 114 can have an edge that is any suitable shape and dimension, including but not limited to a curve. The upper surface 113 of the raised drinking portion 110 can have any suitable shape and dimension, including but not limited to convex barrel shape in the closed configuration. The front edge 116 can have any suitable shape and dimension, including but not limited to a curve defined along an interface between the upper surface 113 of the raised drinking portion 110 and the inner surface of the perimeter wall 106. The front edge 116 of the raised drinking portion 110 can be defined by any suitable method of separation, including, but not limited to a partial or full cut, perforation or score.

Figure 2:
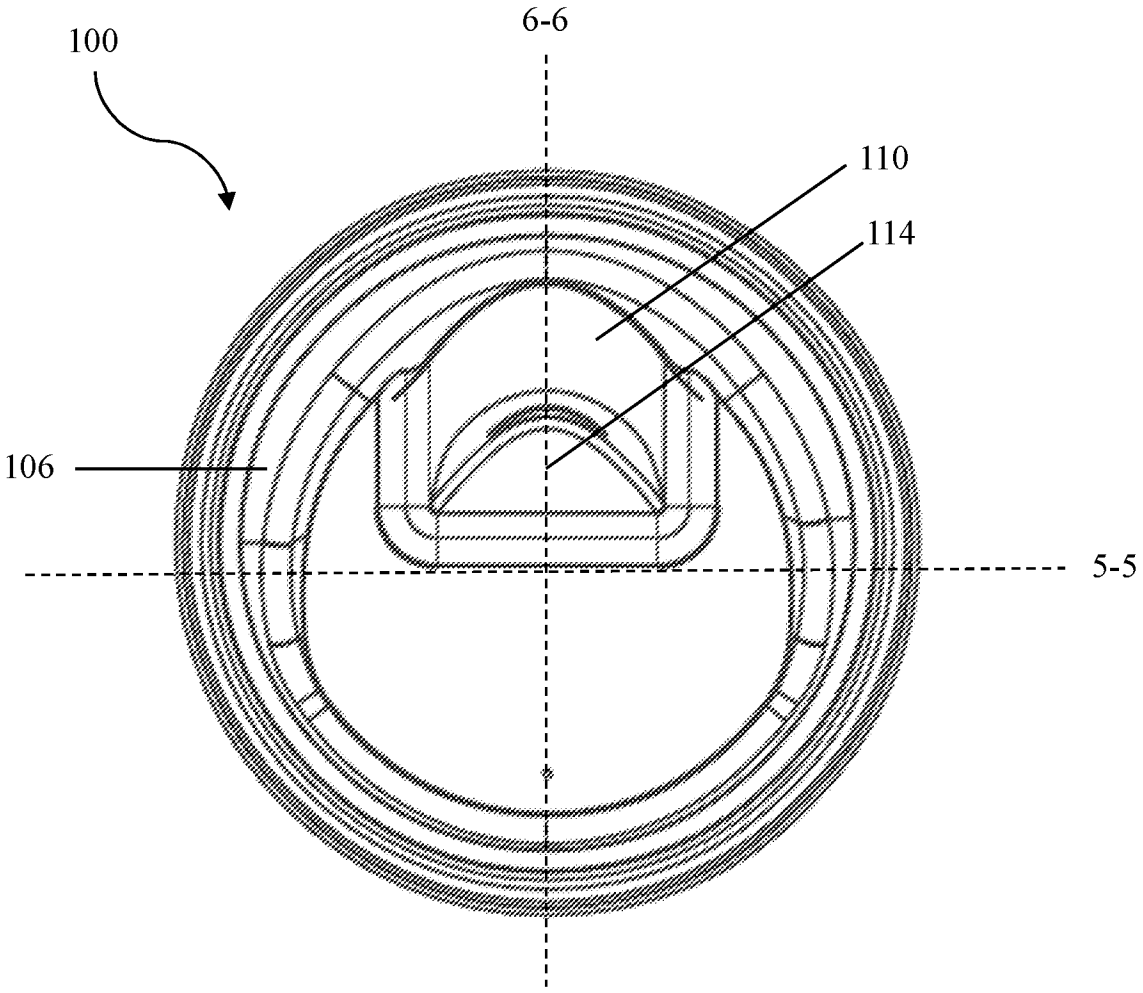
FIG. 2 is a top view of the lid of FIG. 1.
Figure 3:
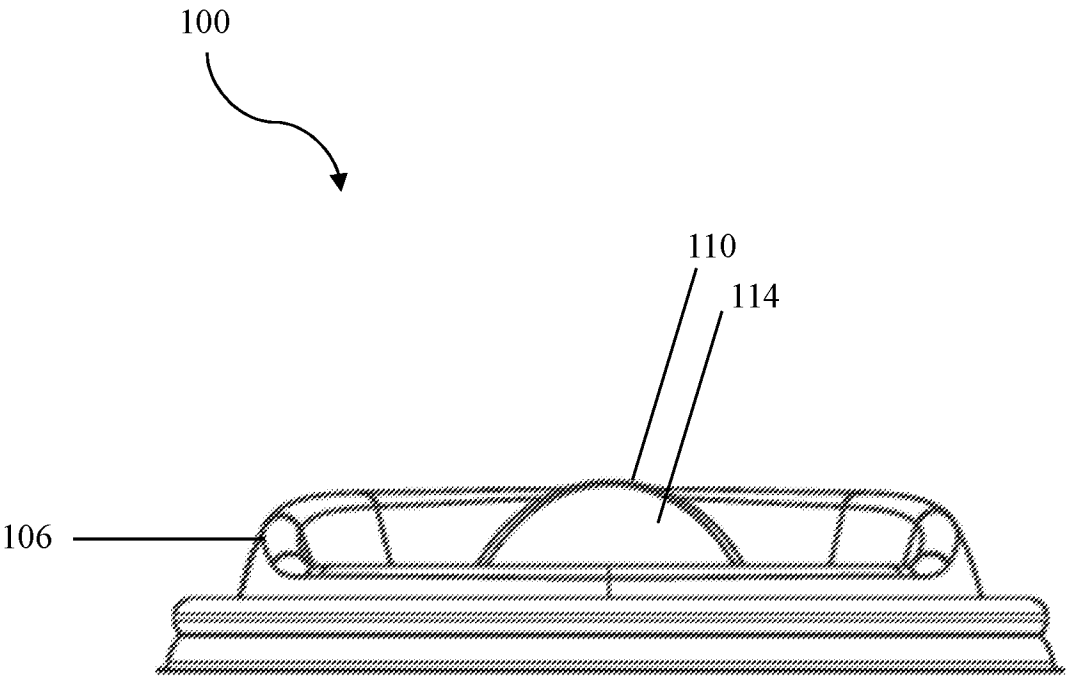
FIG. 3 is a rear side view of the lid of FIG. 1.
Figure 4:
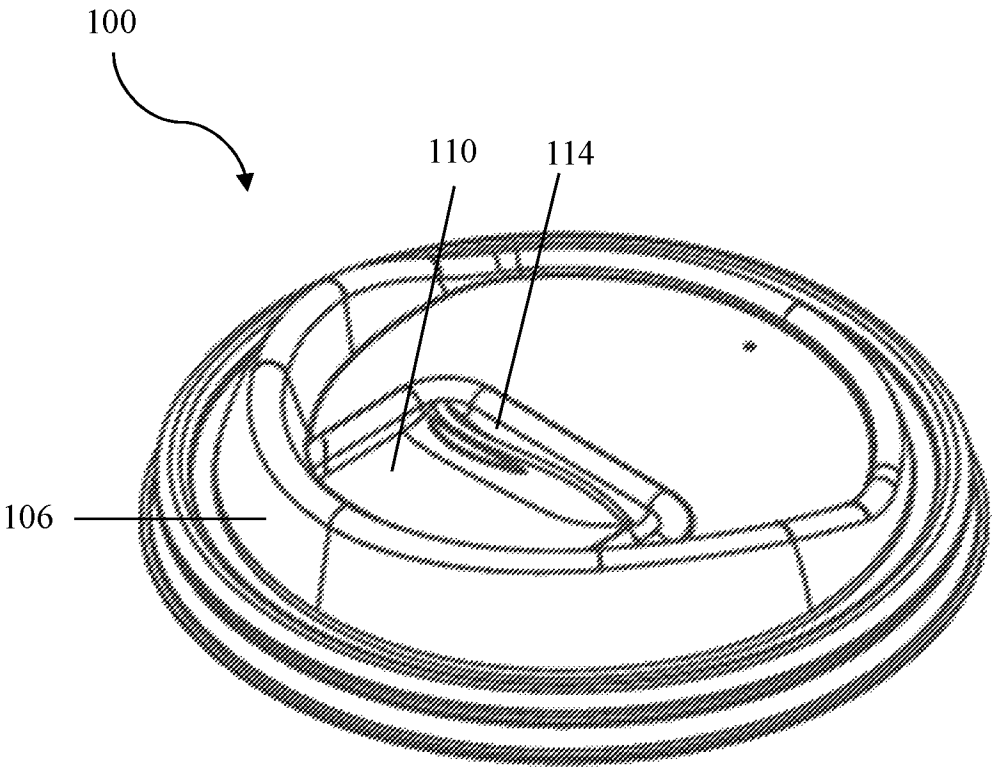
FIG. 4 is a perspective view of the lid of FIG. 1.
Figure 5:
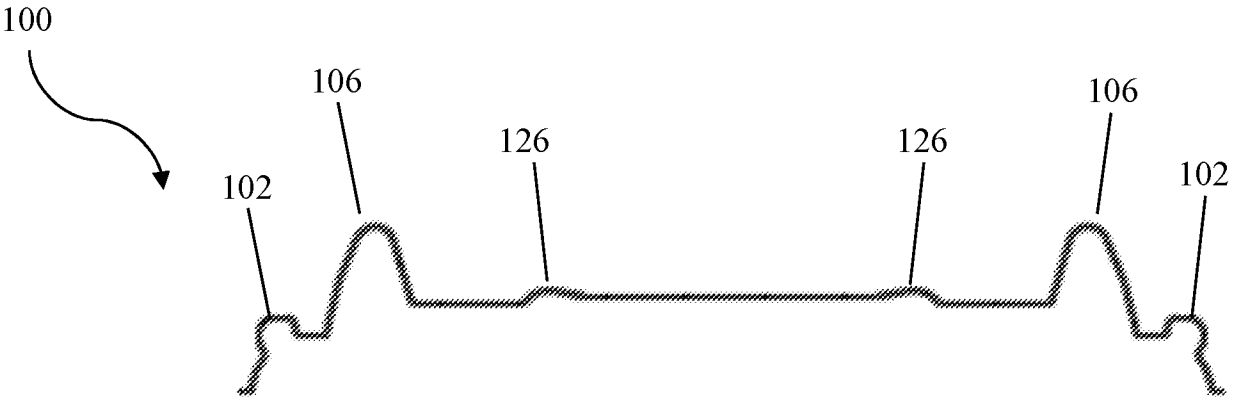
FIG. 5 is a cross-sectional rear side view of the lid of FIG. 1, taken along line 5-5.
Figure 6:
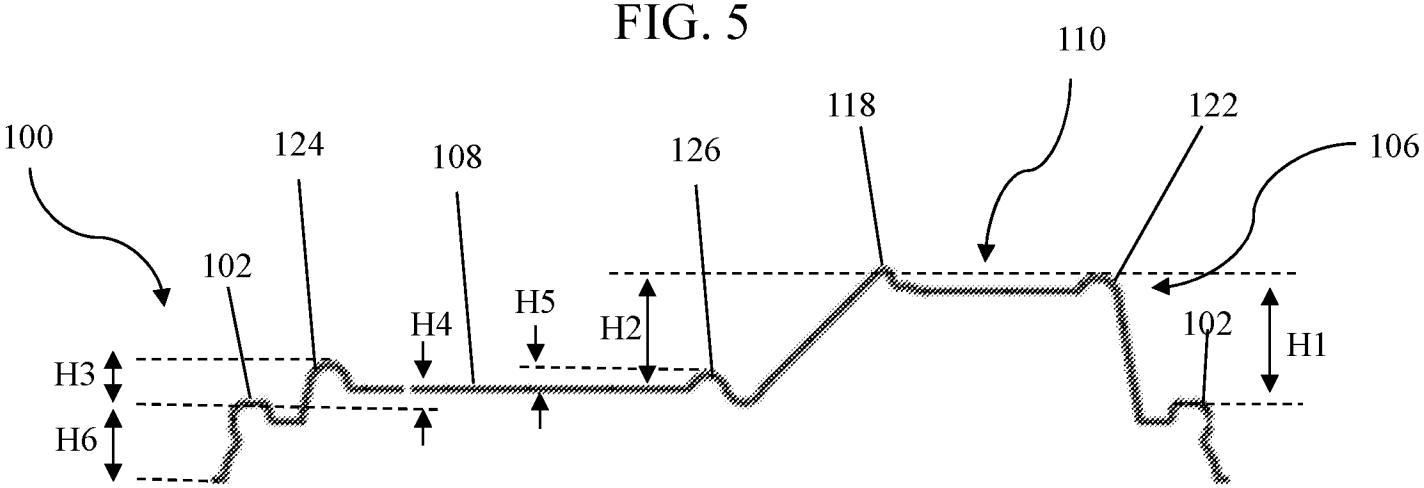
FIG. 6 is a cross-sectional right side view of the lid of FIG. 1, taken along line 6-6.

As shown generally in FIGS. 1-4, the perimeter wall 106 can have a front wall segment 122 and a back wall segment 124. The front wall segment 122 can have a maximum height greater than a maximum height of the back wall segment 124. The front wall segment 122 can taper down from the maximum height of the front wall segment 122 to the maximum height of the back wall segment 124. For example, FIGS. 5 and 6 depict cross-sectional views of the lid 100 of FIG. 1-4, taken along lines 5-5 and 6-6 (as shown in FIG. 2), respectively. As shown in FIG. 6, the front wall segment 122 can have a maximum height H1, where H1 can be approximately 0.38 to 0.75 inch relative to a top of the mounting portion 102. The front wall segment 122 can have a maximum height H2, where H2 can be approximately 0.38 to 0.75 inch relative to the center portion 108. The back wall segment 124 can have a maximum height H3 to provide an anti-drip edge, where H3 can be approximately 0.01 to 0.10 inch relative to a top of the mounting portion 102. Alternatively, for purpose of illustration and not limitation, the back wall segment 124 can be tapered down to 0.0 inch (flush with the top), or the back wall segment 124 can have no taper at all. The center portion 108 can have a maximum height H4 to provide clearance for flush-filled drinks, where H4 can be approximately 0.055 to 0.065 inch relative to the mounting portion 102. Alternatively, for purpose of illustration and not limitation, for menu offerings that do not require clearance to flush-filled drinks, the center portion 108 can recess into the top plane of the cup rim. The center portion 108 can have a vent hole 109.

As shown generally in FIGS. 1-4, the strawless drinking lid 100 can further include a raised projection 126 between the center portion 108 and the raised drinking portion 110. The raised projection 126 can have a maximum height relative to the center portion 108 less than a minimum height of the inner surface of the perimeter wall 106 relative to the center portion 108. As shown in FIG. 6, the raised projection 126 can have a maximum height H5 relative to the center portion 108.

Figure 7:
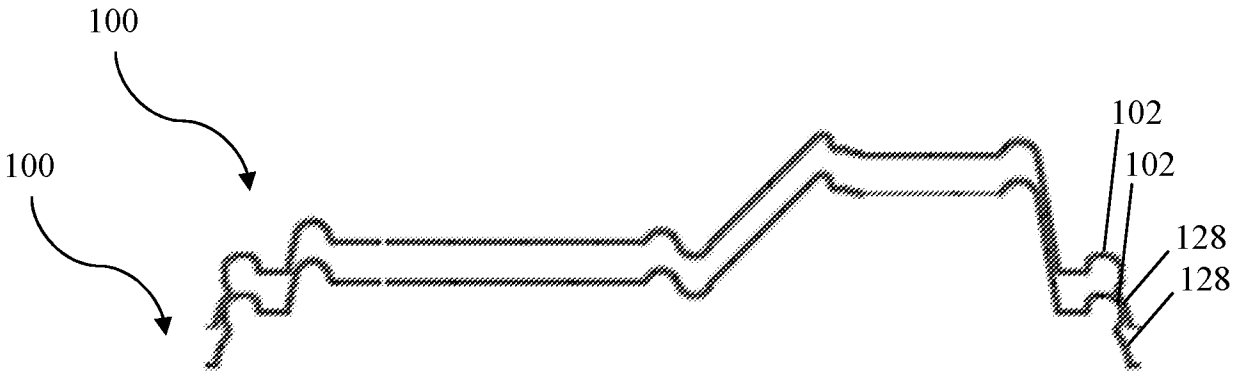
FIG. 7 is a cross-sectional side view of a stacked arrangement of lids of FIG. 1, in accordance with the disclosed subject matter.
Figure 8A:
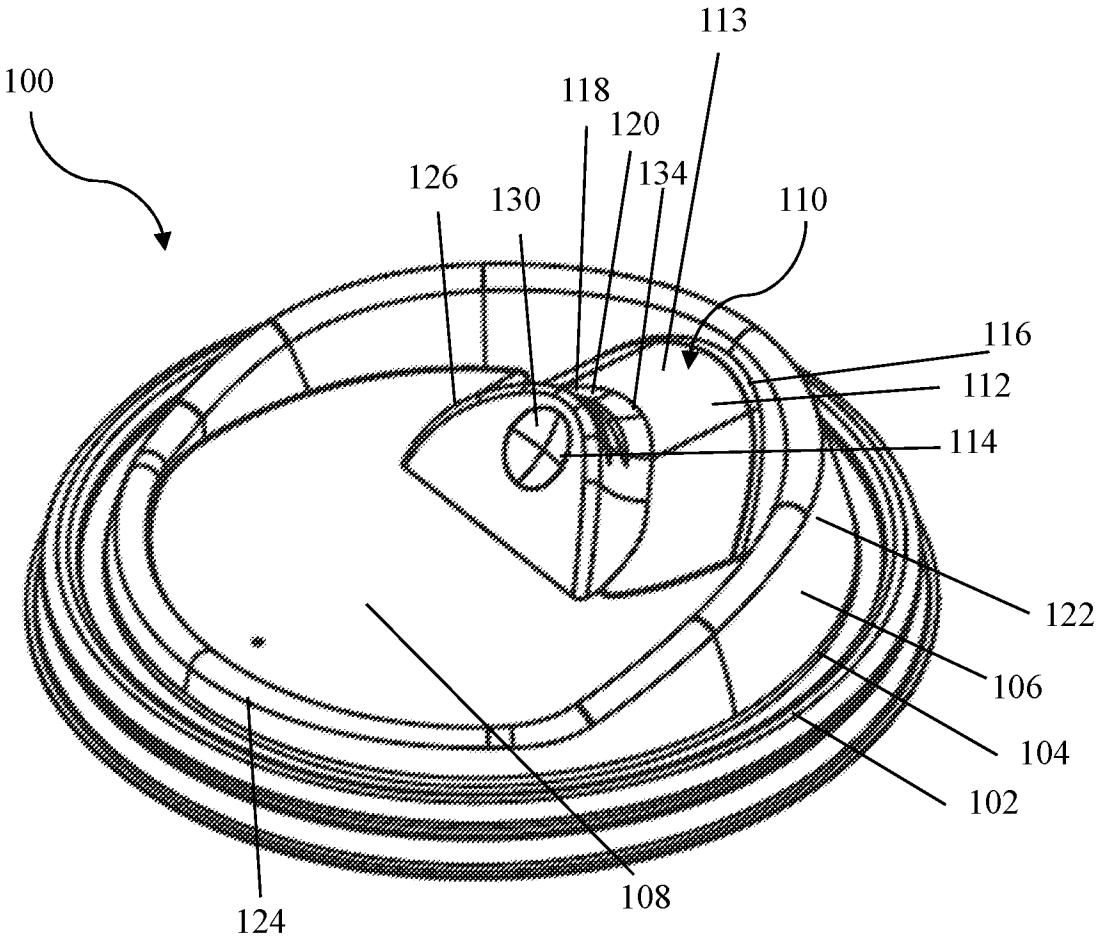
FIG. 8A is a perspective view of a lid for a container according to another aspect of the disclosed subject matter.
Figure 8C:
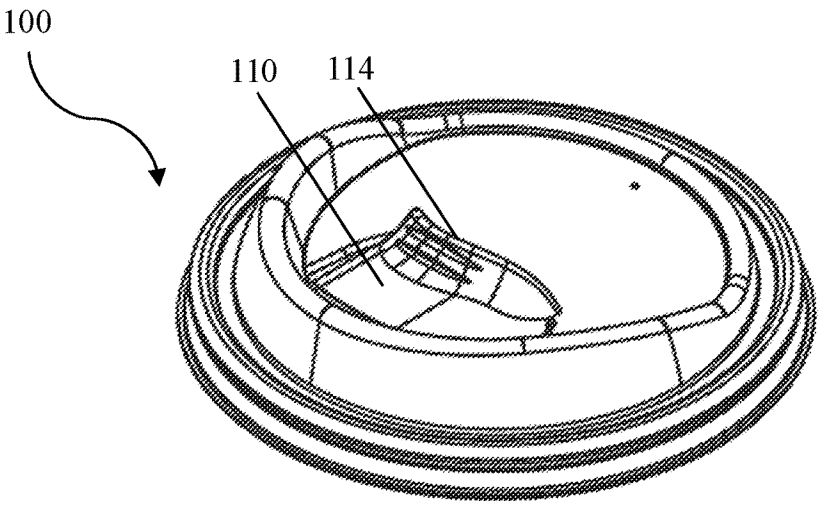
FIG. 8C is a perspective view of the lid of FIG. 8A.
Figure 8D:
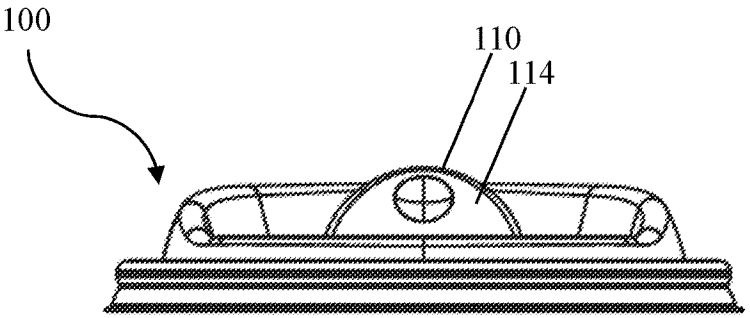
FIG. 8D is a rear side view of the lid of FIG. 8A.
Figure 8B:
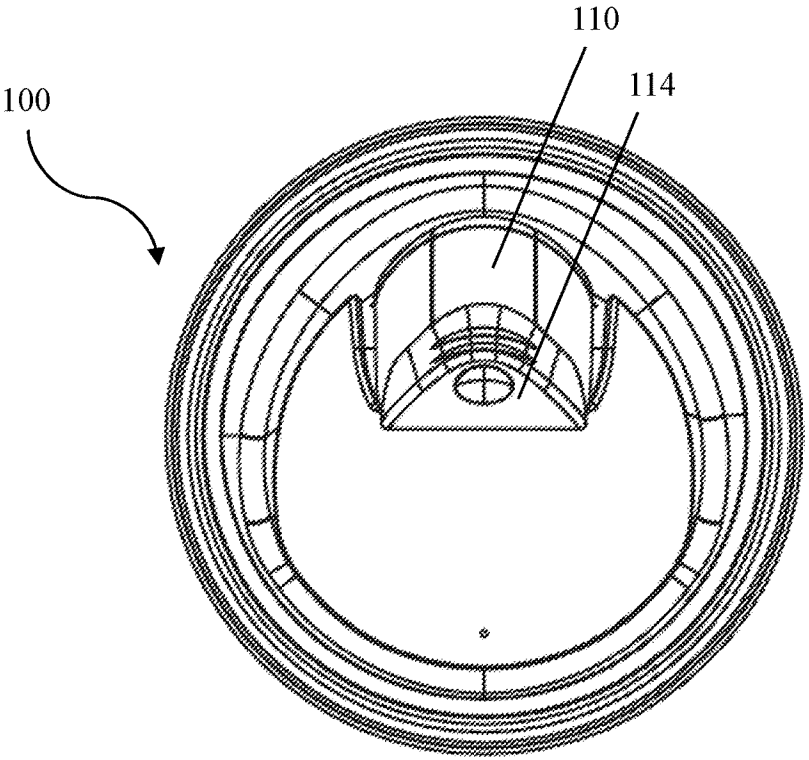
FIG. 8B is a top view of the lid of FIG. 8A.
Figure 9A:
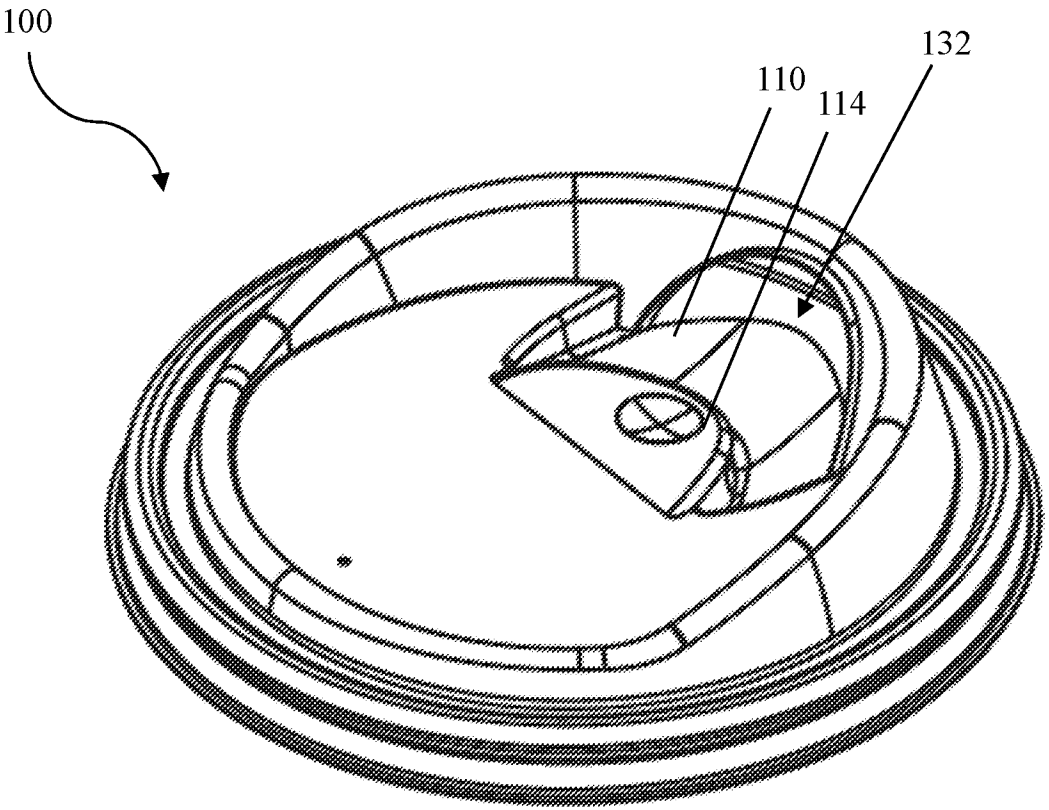
FIG. 9A is a perspective view of the lid of FIG. 8 in the opened configuration.
Figure 9C:
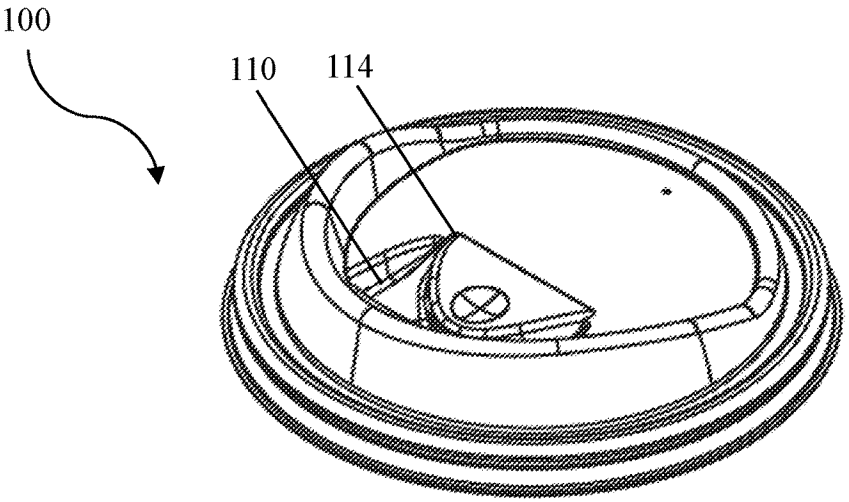
FIG. 9C is a perspective view of the lid of FIG. 9A.
Figure 9D:
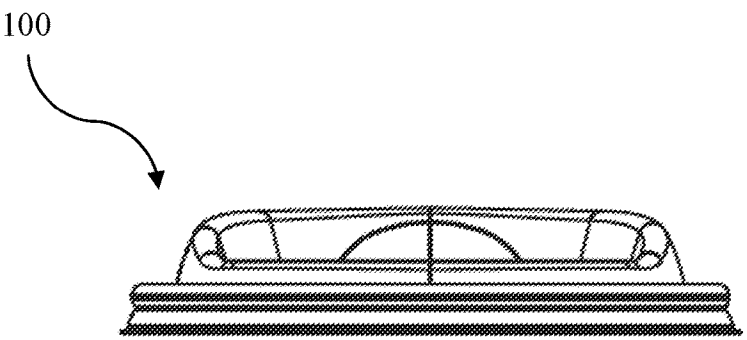
FIG. 9D is a rear side view of the lid of FIG. 9A.
Figure 9B:
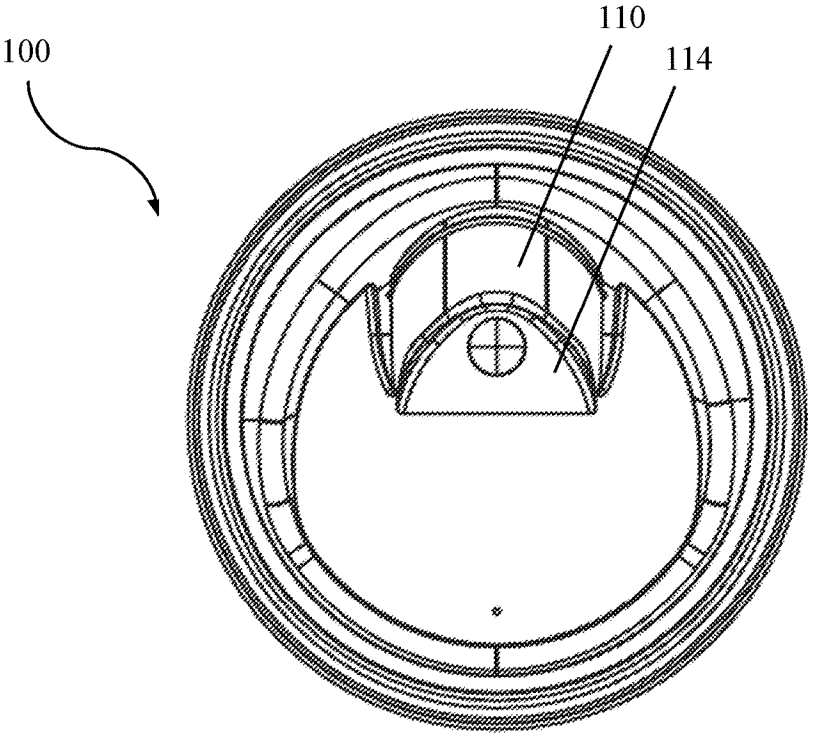
FIG. 9B is a top view of the lid of FIG. 9A.

As shown generally in FIGS. 1-4, the mounting portion 102 can be configured to engage an upper rim of a container. The mounting portion 102 can include an inner shelf 104 extending radially inward to the outer surface of the perimeter wall 106. The outer perimeter defined by the mounting portion 102 can be circular in plan view. As shown in FIG. 6, the mounting portion 102 can have a maximum height H6 to create lid-to-cup seal geometry, where H6 can be approximately 0.25 to 0.35 inch. As shown in FIG. 7, which is a cross-sectional side view of a stacked arrangement of lids 100, the mounting portion 102 of each lid 100 can include a stacking feature 128. As shown in FIG. 7, stacking features 128 align and interlock when two containers are stacked, allowing the container lids to nest when stacked.

In accordance with another aspect of the disclosed subject matter, FIGS. 8A-8D and 9A-9D show a strawless drinking lid 100. Lid 100, as shown in FIGS. 8A-8D and 9A-9D, can have one or more features as included in lid 100 in FIGS. 1-4, such as mounting portion 102, inner shelf 104, perimeter wall 106, center portion 108, raised drinking portion 110, front and back sections 112, 114, front edge 116, ridge 118, at least one groove 120, front and back wall segments 122, 124, projection 126, and hinge line 134. The back section 114 can have a pressure indicator 130. The pressure indicator 130 can have any suitable shape and dimension, including but not limited to circular and concave. As shown in FIGS. 9A-9D, the drinking portion 110 can be configured to be moved from the closed configuration toward the open configuration by an external pushing force applied on the back surface of the back section 114 to create a sip hole opening 132.

In order to create lid 100 in accordance with the disclosed subject matter, a sheet of thermoformable polymeric material can be provided and thermoformed to create a hollow body. For example, the lid 100 can consist essentially of a single-piece thermoformed polymer article. A variety of systems and techniques are known to thermoform a sheet of polymeric material into the general configuration of a container lid. For example, U.S. Pat. Nos. 7,691,302, 7,753,224, 7,789,260, 7,819,271, 8,113,379, and 8,317,050, the contents of which are incorporated herein by reference, disclose various methods of manufacture of container lids. The hollow body can contain one or more of the features as included in lid 100.

In accordance with the disclosed subject matter, the container can be made of a polymeric material. Examples of suitable polymeric materials include, but are not limited to polyethylene terephthalate (PET), unfoamed polyolefin material, and polypropylene polymers, such as, for example polypropylene homopolymers, polypropylene random copolymers, or polypropylene impact polymers, ethylene polymers, such as, for example, high density polyethylene, medium density polyethylene, or low density polyethylene, and mixtures, copolymers, monolayer, laminated multilayer, or coextruded multilayer combinations thereof.

In addition to the disclosed subject matter claimed below, the disclosed subject matter is also directed to other aspects of the disclosed subject matter having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other aspects of the disclosed subject matter having any other possible combinations. Thus, the foregoing description of the disclosed subject matter has been presented for purposes of illustration and description. It is not intended to be exhaustive or to limit the disclosed subject matter to the aspects of the disclosed subject matter disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

What is claimed is:

1. A strawless drinking lid for a container, comprising:

a mounting portion defining an outer perimeter;

a perimeter wall disposed inwardly from the mounting portion, the perimeter wall extending upwardly relative the mounting portion and having an outer surface facing the mounting portion and an inner surface opposite the outer surface;

a center portion extending inwardly from the inner surface of the perimeter wall; and a raised drinking portion extending upwardly from the center portion, the raised drinking portion having a front section and a back section with an upper surface therebetween, the front section of the raised drinking portion having a front edge proximate the inner surface of the perimeter wall, and the back section of the raised drinking portion having a back surface extending upwardly from the center portion, the raised drinking portion having a closed configuration with the upper surface undeformed and the front edge adjacent the inner surface of the perimeter wall, and the raised drinking portion having an open configuration when the upper surface is deformed downwardly to define an opening between the front edge and the inner surface of the perimeter wall.

2. The strawless drinking lid of claim 1, wherein the raised drinking portion is configured to be moved from the closed configuration toward the open configuration by an external pushing force applied on the back surface of the back section.

3. The strawless drinking lid of claim 1, wherein the back section of the raised drinking portion includes a ridge, and the raised drinking portion is configured to be moved from the open configuration toward the closed configuration by an external pulling force applied on the ridge.

4. The strawless drinking lid of claim 3, wherein the ridge is raised relative to the upper surface of the raised drinking portion.

5. The strawless drinking lid of claim 3, wherein the raised drinking portion includes at least one groove disposed in the upper surface.

6. The strawless drinking lid of claim 1, wherein the upper surface includes a hinge line extending across a width of the raised drinking portion and disposed between a front area and a back area of the raised drinking portion.

7. The strawless drinking lid of claim 1, wherein the back surface of the back section of the raised drinking portion is sloped relative to the center portion.

8. The strawless drinking lid of claim 1, wherein the back section of the raised drinking portion has a slope of between approximately 35 to 60 degrees relative to the center portion.

9. The strawless drinking lid of claim 1, wherein the upper surface of the raised drinking portion has a convex barrel shape in the closed configuration.

10. The strawless drinking lid of claim 9, wherein the front edge is a curve defined along an interface between the upper surface of the raised drinking portion and the inner surface of the perimeter wall.

11. The strawless drinking lid of claim 1, further comprising a raised projection between the center portion and the raised drinking portion.

12. The strawless drinking lid of claim 11, wherein the raised projection has a maximum height relative to the center portion less than a minimum height of the inner surface of the perimeter wall relative to the center portion.

13. The strawless drinking lid of claim 1, wherein the perimeter wall has a front wall segment and a back wall segment, wherein the front wall segment has a maximum height greater than a maximum height of the back wall segment.

14. The strawless drinking lid of claim 13, wherein the front wall segment tapers down from the maximum height of the front wall segment to the maximum height of the back wall segment.

15. The strawless drinking lid of claim 13, wherein the maximum height of the front wall segment is approximately 0.38 to 0.75 inch relative to a top of the mounting portion.

16. The strawless drinking lid of claim 1, wherein the mounting portion includes an inner shelf extending radially inward to the outer surface of the perimeter wall.

17. The strawless drinking lid of claim 1, wherein the strawless drinking lid consists essentially of a single-piece thermoformed polymer article.

18. The strawless drinking lid of claim 1, wherein the raised drinking portion is configured to deform downwardly past a point of maximum opening stress to hold the lid in the open configuration.

19. A method of making a strawless drinking lid for a container, comprising:

providing a sheet of thermoformable polymeric material; and thermoforming the sheet to create a hollow body comprising:

a mounting portion defining an outer perimeter;

a perimeter wall disposed inwardly from the mounting portion, the perimeter wall extending upwardly relative the mounting portion and having an outer surface facing the mounting portion and an inner surface opposite the outer surface;

a center portion extending inwardly from the inner surface of the perimeter wall; and a raised drinking portion extending upwardly from the center portion, the raised drinking portion having a front section and a back section with an upper surface therebetween, the front section of the raised drinking portion having a front edge proximate the inner surface of the perimeter wall, and the back section of the raised drinking portion having a back surface extending upwardly from the center portion, the raised drinking portion having a closed configuration with the upper surface undeformed and the front edge adjacent the inner surface of the perimeter wall, and the raised drinking portion having an open configuration when the upper surface is deformed downwardly to define an opening between the front edge and the inner surface of the perimeter wall.

20. The method of claim 19, wherein the raised drinking portion is configured to be moved from the closed configuration toward the open configuration by an external pushing force applied on the back surface of the back section.

* * * * *